US007841332B2

(12) United States Patent
Pottenger et al.

(10) Patent No.: US 7,841,332 B2
(45) Date of Patent: Nov. 30, 2010

(54) BURNER WITH FLAME STABILITY

(75) Inventors: John Pottenger, Hendersonville, TN (US); William A. Pryor, Portland, TN (US); Piero Armanni, Forli (IT); Paulo Serenellini, Ancona (IT)

(73) Assignee: Electrolux Home Products, Inc., Cleveland, OH (US)

( * ) Notice: Subject to any disclaimer, the term of this patent is extended or adjusted under 35 U.S.C. 154(b) by 80 days.

(21) Appl. No.: 12/031,075

(22) Filed: Feb. 14, 2008

(65) Prior Publication Data

US 2009/0205630 A1 Aug. 20, 2009

(51) Int. Cl.

| | |
|---|---|
| ***F23D 14/06*** | (2006.01) |
| *F23D 14/46* | (2006.01) |
| *F23D 14/58* | (2006.01) |
| *F23Q 3/00* | (2006.01) |
| *F24C 3/08* | (2006.01) |

(52) U.S. Cl. ..... 126/39 E; 126/39 R; 431/278; 431/283; 431/285; 431/286; 431/365; 239/86; 239/548; 239/561

(58) Field of Classification Search ..... 126/39 E, 126/39 R; 431/263, 278, 283, 285, 286, 431/354; 239/86, 548, 552, 553, 553.3, 553.5, 239/556, 558, 560, 561, 568; *F23D 14/06, F23D 14/46, 14/58; F23Q 3/00, 7/06; F24C 3/00, F24C 3/08, 15/10, 15/20; F26C 3/08*
See application file for complete search history.

(56) References Cited

U.S. PATENT DOCUMENTS

| | | | | |
|---|---|---|---|---|
| 4,518,346 | A * | 5/1985 | Pistien | 431/266 |
| 4,757,801 | A | 7/1988 | Le Monnier de Gouville et al. | |
| 5,133,658 | A | 7/1992 | Le Monnier De Gouville et al. | |
| 5,397,234 | A | 3/1995 | Kwiatek | |
| 5,408,984 | A | 4/1995 | Maughan | |
| 5,464,004 | A | 11/1995 | Maughan | |
| 5,488,942 | A | 2/1996 | Maughan | |
| 5,492,469 | A * | 2/1996 | Oda et al. | 431/266 |
| 5,800,159 | A * | 9/1998 | Maughan et al. | 431/349 |
| 5,899,681 | A * | 5/1999 | Maughan | 431/8 |
| 5,915,956 | A | 6/1999 | Kwiatek et al. | |

(Continued)

FOREIGN PATENT DOCUMENTS

| | | | |
|---|---|---|---|
| JP | 07217879 | A * | 8/1995 |

(Continued)

*Primary Examiner*—Steven B McAllister
*Assistant Examiner*—Daniel E Namay
(74) *Attorney, Agent, or Firm*—Pearne & Gordon LLP

(57) ABSTRACT

The present invention concerns a burner assembly that includes a burner body having a combustible gas chamber from which a combustible gas is distributed to a plurality of burner ports at which the combustible gas can be combusted and a stability chamber in gas-flow communication with the combustible gas chamber for maintaining the combustion of the combustible gas in the stability chamber whenever the combustion of the combustible gas at the plurality of burner ports is disturbed, whereby the combustion of the combustible gas at the plurality of the burner ports may be resumed upon the cessation of the disturbance. The burner assembly can also include a burner cap for closing off the top of the burner body so as to substantially preclude the escape of the combustible gas from the combustible gas chamber, the stability gas chamber and the burner ports at the top of the burner body.

20 Claims, 2 Drawing Sheets

U.S. PATENT DOCUMENTS 5,934,896 A * 8/1999 Kwiatek ..... 431/266
6,082,994 A * 7/2000 Grandveau et al. ..... 431/349
6,095,802 A 8/2000 Kwiatek
6,135,764 A * 10/2000 Kwiatek ..... 431/266
6,315,552 B1 11/2001 Haynes et al.
6,371,754 B1 4/2002 Haynes
6,439,881 B2 8/2002 Haynes et al.
6,439,882 B2 8/2002 Haynes et al.
6,679,699 B2 1/2004 Yam et al.
6,764,303 B2 7/2004 Dane et al.
6,780,009 B2 * 8/2004 Harneit ..... 431/354
6,817,353 B2 * 11/2004 Atkinson et al. ..... 126/39 E
6,877,503 B1 4/2005 Hibshman, II et al.
6,889,685 B2 * 5/2005 Dane ..... 126/39 B
6,935,328 B2 * 8/2005 Haynes et al. ..... 126/41 R
7,017,572 B2 * 3/2006 Cadima ..... 126/39 E
7,291,009 B2 * 11/2007 Kamal et al. ..... 431/284
7,527,495 B2 * 5/2009 Yam et al. ..... 431/283
2004/0072112 A1 * 4/2004 Harneit ..... 431/266
2004/0241604 A1 12/2004 Cadima
2004/0250808 A1 12/2004 Haynes et al.
2005/0112520 A1 * 5/2005 Todoli et al. ..... 431/349
2005/0142511 A1 6/2005 Yam et al.
2005/0194001 A1 9/2005 Armanni
2007/0128563 A1 * 6/2007 Subramanian et al. ..... 431/278
2009/0087804 A1 * 4/2009 Pryor et al. ..... 431/350
2009/0159071 A1 * 6/2009 Cadima et al. ..... 126/39 E

FOREIGN PATENT DOCUMENTS

JP 2003329219 A * 11/2003

* cited by examiner

BURNER WITH FLAME STABILITY

BACKGROUND OF THE INVENTION

The present invention relates to burners that burn a combustible gas, and, in particular, the invention concerns burners of the type that are used in cooking appliances of various kinds.

Gas burners such as gas surface burners, for example, that are used with domestic gas ranges typically include a burner body or head that includes a plurality of burner ports through which a combustible gas is distributed to the exterior of the burner body. A burner cap can be provided at the top of the burner body so as to close off the interior of the burner body to the escape of the combustible gas. Usually a mixing conduit introduces a mixture of a gaseous fuel and air as the combustible gas into the burner body. The gas-air mixture can be confined in combustible gas plenum within the burner body that is closed off by the burner cap. From the plenum, the combustible gas typically passes through the burner ports and is ignited by an igniter and burned. Often times the burner body has a circular configuration so that a ring of discrete flames emanating from the burner ports is established. The gaseous fuel typically comprises natural gas (which is primarily methane), propane, butane or mixtures thereof.

One of the conditions affecting the performance of combustible gas burners concerns airflow disturbances that can arise at the burners upon the occurrence, for example, of ambient air drafts or drafts that are caused by the rapid opening and closing of doors and drawers, such as range oven doors and range storage drawers, that are provided in the cabinets in which the burners are located. Airflow disturbances of these and other types can affect the stability of the flames at the burner ports even to the extent of causing extinction of the flames. Flame extinction caused by airflow disturbances is a nuisance at least for the reason that the burner must be reignited.

SUMMARY OF THE INVENTION

According to one aspect, the present invention concerns a burner assembly comprising a burner body having a plurality of burner ports at which the combustible gas can be combusted and a stability chamber where the combustion of the combustible gas can be maintained whenever the combustion of the combustible gas at the plurality of burner ports is disturbed, whereby the combustion of the combustible gas at the plurality of the burner ports may be resumed upon the cessation of the disturbance.

According to another aspect, a burner assembly at which a combustible gas is combusted comprises a burner body including a combustible gas chamber for holding the combustible gas, a plurality of burner ports and a stability chamber in gas-flow communication with the combustible gas chamber. This arrangement allows the combustible gas to flow from the combustible gas chamber to within the stability chamber for maintaining the combustion of the combustible gas in the stability chamber whenever the combustion of the combustible gas at the plurality of burner ports is disturbed. As a result, the combustion of the combustible gas at the plurality of the burner ports may be resumed upon the cessation of the disturbance. The stability chamber includes at least one upper edge that is adapted to engage the undersurface of a burner cap for closing off the top of the burner, the at least one upper edge of the stability chamber being configured so as to prevent movement of the burner cap on the burner body in at least one direction laterally of the burner body when the at least one upper edge of the stability chamber and the undersurface of the burner cap are engaged.

According to yet another aspect, the burner assembly at which a combustible gas is combusted includes a burner body including an exterior surface, a first interior surface and a second interior surface spaced from the first interior surface, the first interior surface and the second interior surface being joined by a connecting surface to form a combustible gas chamber. A plurality of burner ports provide openings in the exterior surface and the first interior surface of the burner body through which the combustible gas can pass from the combustible gas chamber to the exterior of the burner body and be combusted at the burner ports exterior of the burner body. A stability chamber is in gas-flow communication with the combustible gas in the combustible gas chamber for maintaining the combustion of the combustible gas in the stability chamber whenever the combustion of the combustible gas at the plurality of burner ports is disturbed, whereby the ccnmbustion of the combustible gas at the plurality of the burner ports may be resumed upon the cessation of the disturbance. The stability chamber extends from the second interior surface of the burner body to the exterior surface of the burner body and includes an opening that provides for the gas-flow communication between the combustible gas chamber and the stability chamber, whereby the combustible gas can flow from the combustible gas chamber to within the stability chamber.

In a particular instance where the stability chamber includes at least one upper edge that is configured so as to prevent movement of the burner cap on the burner body in at least one direction laterally of the burner body when the at least one upper edge of the stability chamber and the undersurface of the burner cap are engaged, the at least one upper edge of the stability chamber has an irregular configuration. The irregular configuration is adapted to engage a complementary irregular configuration at the undersurface of the burner cap so as to prevent movement of the burner cap on the burner body in at least one direction laterally of the burner body. In another particular instance, the irregular configuration of the at least one upper edge of the stability chamber and the complementary irregular configuration of the undersurface of the burner cap comprise step-like configurations. In a further particular instance, the at least one upper edge of the stability chamber includes a portion that provides at least a portion of an opening between the stability chamber and the combustible gas chamber when the burner cap is in place on the burner body, whereby the combustible gas can flow from the combustible gas chamber to within the stability chamber.

A stability chamber can comprise a pair of oppositely disposed side walls, each of which extends from a first end at the second interior surface of the burner body to a second end at the exterior surface of the burner body. At least one of the side walls has an opening that provides gas-flow communication between the combustible gas chamber and the stability chamber, whereby the combustible gas can flow from the combustible gas chamber to within the stability chamber. A front wall of the stability chamber is located at the second interior surface and joins the first ends of the oppositely disposed side walls of the stability chamber. A rear wall of the stability chamber at least partially joins the second ends of the oppositely disposed side walls, and a bottom wall of the stability chamber is joined to the pair of oppositely disposed side walls, the front wall and the rear wall so as to close off the bottom of the stability chamber.

According to still a further aspect, each of the pair of oppositely disposed side walls is arranged substantially transversely to the exterior surface, the first interior surface and the second interior surface. Each of the oppositely disposed side walls includes an upper edge comprising a first portion and a second portion aligned substantially end to end from the exterior surface of the burner body toward the second interior surface of the burner body with the second portion of the upper edge being located below the first portion of the upper edge nearer a bottom wall of the stability chamber. The first portion of the upper edge of each side wall extends between the second end of the side wall at the exterior surface and the second portion of the upper edge of the side wall. The second portion of the upper edge of each side wall extends from the first portion of the upper edge of the side wall toward the second interior surface. The upper edge of the at least one of the side walls in this aspect includes a third portion aligned substantially end to end with the first and second portions of the upper edge of the side wall and extends between the second portion of the upper edge of the side wall and the first end of the side wall at the second interior surface. The third portion of the upper edge of the at least one of the side walls in this aspect forms at least a portion of the opening in the at least one of the side walls that is in gas-flow communication with the combustible gas chamber whereby combustible gas can flow from the combustible gas chamber to within the stability chamber.

In particular instances of the foregoing aspects, the first portion of the upper edge of each side wall is arranged substantially horizontally and the second portion of the upper edge of each side wall is arranged at an angle to the horizontal such that the second portion of the upper edge of the side wall extends in an upward direction from the first portion of the upper edge of the side wall toward the second interior surface.

In all the foregoing aspects, a burner cap can be provided for closing off the top of the burner body, including the top of the stability chamber so as to substantially preclude the escape of the combustible gas from the combustible gas chamber, the stability gas chamber and the burner ports at the top of the burner body. The burner cap can have an undersurface that is configured to complementarily engage the first and second portions of the upper edges of the side walls of the stability chamber so as to substantially preclude the passage of the combustible gas between the stability chamber and the combustion gas chamber at the first and second portions of the upper edges of the side walls of the stability chamber.

BRIEF DESCRIPTION OF THE DRAWINGS

In the drawings, like reference numerals represent like elements and components of the drawings.

DETAILED DESCRIPTION OF AN INVENTION EMBODIMENT

Figure 1:
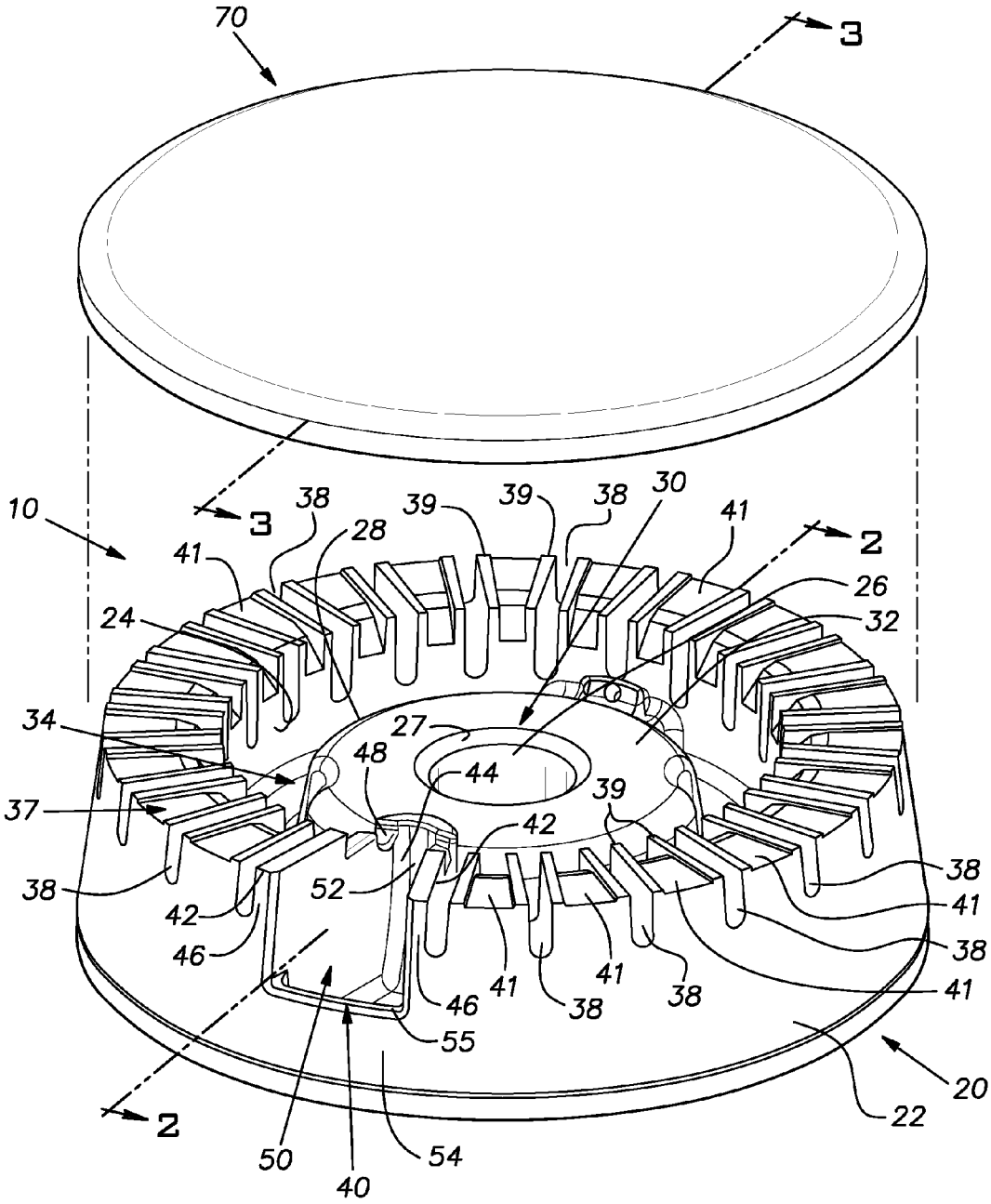
FIG. 1 is an exploded perspective view of an embodiment of the burner assembly of the invention.

Referring to the drawings there is shown an embodiment of the burner assembly of the invention indicated generally at 10 at which a combustible gas can be combusted. The burner assembly 10 includes a burner body or burner head indicated generally at 20 and a stability chamber indicated generally at 40. The embodiment of the burner assembly shown in the drawings is illustrated as also including a cap indicated generally at 70. The burner body 20 includes an exterior surface 22 that has the general shape of a truncated cone and a first interior surface 24 that generally is cylindrical in configuration. The exterior surface 22 and the interior surface 24 girdle, on opposite sides, an annular structure indicated generally at 30. Located substantially centrally of the confines of the annular structure 30 is an annular projection indicated generally at 32 that includes an opening 26 located substantially centrally in the annular projection 32. The opening 26 is in gas flow communication with a source of a combustible gas not shown such that the combustible gas may be introduced into the interior of the burner body 20. The opening 26 can be provided with a chamfer or sloped surface 27 where the combustible gas exits the opening 26 although such a chamfer need not be included in all cases.

The annular projection 32 includes an outer surface 28 that is substantially cylindrical in configuration and comprises a second interior surface of the burner body 20 that is spaced from the first interior surface 24. The first interior surface 24 and the second interior surface 28 are joined by a connecting surface or floor 36 to form a combustible gas chamber, indicated generally at 34 therebetween. The combustible gas chamber 34, substantially annular in shape, is included in the burner body 20 and acts to hold the combustible gas in the burner body. Thus, combustible gas that enters the interior of the burner body 20 through opening 26 is first confined to the annular combustible gas chamber 34 between the first interior surface 24 and the second interior surface 28 for subsequent distribution to burner ports 38 as described below. The connecting surface 36 closes off the bottom of the combustible gas chamber 34 and the top of the combustible gas chamber can be closed off by the burner cap 70 as described below.

A plurality of burner ports 38 in the burner body 20 provides openings in the exterior surface 22 and the first interior surface 24 of the burner body and through the annular structure 30. It is through the burner ports 38 that combustible gas can pass from the combustible gas chamber 34 to the exterior of the burner body 20 and be combusted at the burner ports at the exterior of the burner body. In this manner, a ring of discrete flames are established at the burner ports at the exterior surface 22 of the burner body 20. In addition to the burner ports 38, there are provided at the top of the annular structure 30 between adjacent burner ports 38 crossover ports indicated generally at 37. Each crossover port comprises a pair of protecting side walls 39 and a floor 41 that is located between and below the top of the pair of projecting side walls 39. Particularly when combustible gas is being delivered at relatively low rates of flow, gas from the combustible gas chamber 34 will have an opportunity to move to the top of the annular structure 30 and pass to the exterior of the burner body 20 through the crossover ports 37. As the gas does so, it will be combusted at the crossover ports and a substantially continuous ring of flame will be established at the burner ports 38 and the crossover ports 37.

It can be the case that the combustion of the combustible gas at the burner ports 38 and the combustion of the gas at the crossover ports 37 at relatively low rates of gas flow are disturbed as a result for example of a sudden draft of air that can arise in the surrounding ambient environment or that can arise as a result of the opening and closing of a door or drawer on the appliance at which the burner assembly is located. What occurs in these circumstances is that the movement of the air separates the flames at the burner ports and the crossover ports from the combustible gas entering the burner ports and the crossover ports, respectively, from the combustible gas chamber 34 such that the flames are extinguished or are at risk of being extinguished. To deal with such circumstances, the present invention provides a stability chamber 40 as will now be described.

The stability chamber 40 extends from the second interior surface 28 of the burner body 20 to the exterior surface 22 of the burner body. The stability chamber 40 has an opening described below that provides gas-flow communication between the combustible gas chamber 34 and the stability chamber 40 whereby the combustible gas can flow from the combustible gas chamber to within the stability chamber. This arrangement allows for maintaining the combustion of the combustible gas in the stability chamber 40 whenever the combustion of the combustible gas at the plurality of burner ports 38 and the crossover ports 37 (in those instances when gas is in the process of being combusted at the crossover ports) is disturbed so that the combustion of the combustible gas at the plurality of burner ports and the crossover ports may be resumed upon the cessation of the disturbance. More specifically, the stability chamber 40 comprises a pair of oppositely disposed side walls 42. Each side wall 42 extends from a first end 44 of the side wall at the second interior surface 28 to a second end 46 of the side wall at the exterior surface 22. At least one of the side walls has an opening 48 in gas-flow communication with the combustible gas chamber 34 whereby the combustible gas can flow from the combustible gas chamber 34 to the interior of the stability chamber indicated generally at 50. In the embodiment of the invention shown in the drawings, both side walls 42 have openings 48.

The stability chamber 40 also includes a front wall 52 that is located at the second interior surface 28 and joins the first ends 44 of the oppositely disposed side walls 42 of the stability chamber. Also included as a part of the stability chamber 40 is a rear wall 54 that as least partially joins the second ends 46 of the oppositely disposed side walls 42 and a bottom wall 56 that is joined to the pair of oppositely disposed side walls 42, the front wall 52 and the rear wall 54 so as to close off the bottom of the stability chamber.

In the embodiment of the invention shown in the drawings, each of the pair of oppositely disposed side walls 42 is arranged substantially transversely to the exterior surface 22, the first interior surface 24 and the second interior surface 28. In that particular embodiment, the side walls 42 are arranged so that the first ends 44 of the side walls are nearer one another than the second ends 46 of the side walls such that the stability chamber 40 is wedge-shaped. The stability chamber 40 includes at least one upper edge. In the illustrated embodiment, each of the oppositely disposed side walls 42 includes an upper edge indicated generally at 58. Each upper edge 58 includes a first portion 60 and a second portion 62 that are aligned substantially end to end from the exterior surface 22 of the burner body 20 toward the second interior surface 28 of the burner body. The second portion 62 of each side wall 42 is located below the first portion 60 of each side wall, nearer the bottom wall 56 of the stability chamber. The first portion 60 of the upper edge 58 of each side wall 42 extends between the second end 46 of the side wall at the exterior surface 22 and the second portion 62 of the upper edge 58 of the side wall 42. The second portion 62 of the upper edge 58 of each side wall 42 extends from the first portion 60 of the upper edge 58 of the side wall 42 toward the second interior surface 28. The upper edge 58 of at least one of the side walls 42 includes a third portion 64 that is aligned substantially end to end with the first portion 60 of the upper edge 58 and the second portion 62 of the upper edge 58 and extends between the second portion 62 of the upper edge 58 of the side wall 42 and the first end 44 of the side wall at the second interior surface 28. The third portion 64 of the upper edge 58 of at least one of the side walls 42 forms at least a portion of the opening 48 in at least one of the side walls that is in gas-flow communication with the combustible gas chamber 34 whereby combustible gas can flow from the combustible gas chamber to within the stability chamber 40. In the embodiment of the invention shown in the drawings, each of the side walls 42 is provided with a third portion 64 at the upper edge 58 of the side wall that forms at least a portion of the opening 48 in the side wall that is in gas-flow communication with the combustible gas chamber 34.

In the illustrated embodiment the first portion 60 of the upper edge 58 of each side wall 42 is arranged substantially horizontally. The second portion 62 of the upper edge 58 of each side wall 42 on the other hand is arranged at an angle to the horizontal such that the second portion 62 of the upper edge 58 of each side wall 42 extends in an upward direction from the first portion 60 of the upper edge 58 of each side wall 42 toward the third portion 64 of the upper edge 58 of the side wall 42.

The embodiment of the burner assembly shown in the drawings also includes a burner cap 70 for closing off the top of the burner body 20, including the top of the stability chamber 40, so as to substantially preclude the escape of the combustible gas from the combustible gas chamber 34, the stability gas chamber 40, the burner ports 38 and crossover ports 37 at the top of the burner body. More specifically, the burner cap 70 has an undersurface indicated generally at 72 that is configured as shown generally at 74 to complementarily engage the first portion 60 and the second portion 62 of the upper edges 58 of the side walls 42 of the stability chamber 40 so as to substantially preclude the passage of the combustible gas between the stability chamber 40 and the combustion gas chamber 34 at the first portions 60 and second portions 62 of the upper edges 58 of the side walls 42 of the stability chamber 40. In other words, the undersurface 72 is configured at 74 so as to have an opposite profile in relief as the profile in relief established by the first portion 60 and the second portion 62 of the upper edge 58 of each side wall 42, whereby the configuration at 74 can be seated within the profile in relief established by the first portion 60 and the second portion 62 of the upper edge 58 of each side wall 42. At the same time, in order to allow for the flow of combustible gas from the gas chamber 34 to the interior 50 of the stability chamber 40, the opening 48 formed in at least one of the side walls 42 is not obstructed.

Figure 3:
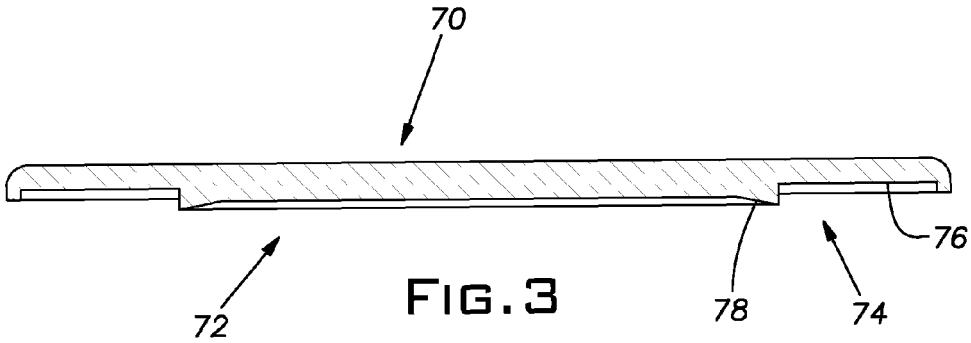
FIG. 3 is a cross-sectional plan view through line 3-3 of FIG. 1.
Figure 2:
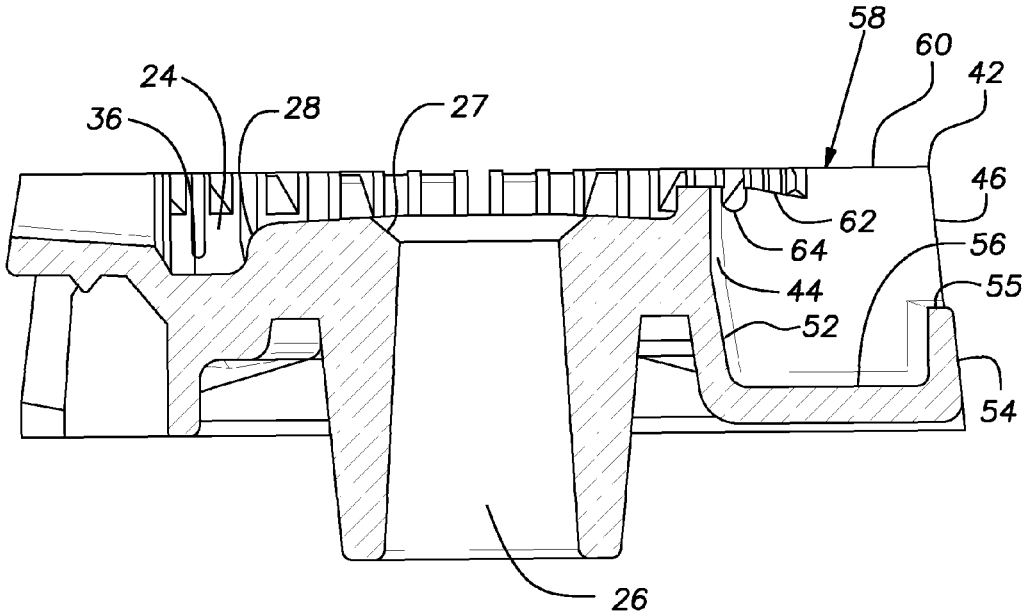
FIG. 2 is a cross-sectional plan view through line 2-2 of FIG. 1.

By way of further description of the configuration 74, as best illustrated in FIG. 3, it can be seen that the configuration 74 comprises an outward component 76 that seats in a complementary fashion on the first portions 60 of the stability chamber walls 42 and an inward component 78 that seats in a complementary fashion on the second portions 62 of the stability chamber walls 42. As illustrated, the outward component 76 and the inward component 78 are present in a continuous circle at the undersurface 72 of the cap 70 so that the cap can be appropriately placed onto the burner body 20 without the necessity of aligning any particular portion of the circumference of the cap with the stability chamber. When the cap is in place on the burner 20, the inclined attitudes of the second portions 62 of the upper edges of the side walls of the stability chamber and the inward component 78 at the undersurface 72 of the cap 70 serve to maintain the cap securely in place on the burner body. The cap is supported around its entire perimeter at the undersurface 72 of the cap above the crossover ports 37. More specifically, the outward component 76 of the undersurface 72 of the cap rests on the tops of the outside walls 39 of the crossover ports 37 and the first portions 60 of the upper edges 58 of the side walls 42. This arrangement of the first portion 60 and the second portion 62 of an upper edge 58 together with the outward component 76 and the inward component 78 at the undersurface 72 of the cap 70 serves to prevent movement of the burner cap on the burner body in at least one direction laterally of the burner body when the burner body and the burner cap are engaged. Thus, in the embodiment of the drawings, the burner cap when in place on the burner body cannot slide off the burner body.

Also in the embodiment shown in the drawings, the bottom wall 56 of the stability chamber 40 is located at a level in the burner body 20 that is lower than the level of the burner ports 38 and the combustible gas chamber 34. In addition, the top 55 of the rear wall 54 of the stability chamber 40 extends to a location above the bottom wall 56 of the stability chamber 40 and below the upper edges 58 of the pair of opposed side walls 42.

Based on the foregoing description, it will be understood that a stability chamber such as chamber 40 for example includes at least one upper edge (at least one of the upper edges 58 for example) that is adapted to engage or engages the undersurface of a burner cap (undersurface 72 of burner cap 70 for example) for closing off the top of the burner body such as burner body 20. As explained above, the at least one upper edge of the stability chamber is configured so as to prevent movement of the burner cap on the burner body in at least one direction laterally of the burner body when the at least one upper edge of the stability chamber and the undersurface of the burner cap are engaged. It will also be understood from the foregoing description that the at least one upper edge of the stability chamber includes a portion such as portion 64 that provides at least a portion of an opening such as opening 48 between the stability chamber and the combustible gas chamber when the burner cap is in place on the burner body, whereby the combustible gas can flow from the combustible gas chamber to within the stability chamber.

It also will be apparent from the foregoing description that the at least one upper edge of the stability chamber can have an irregular configuration such as the configuration provided by the first portion 60 and the second portion 62 of the at least one upper edge of the stability chamber that is adapted to engage or engages a complementary irregular configuration at the undersurface of the burner cap such as outward component 76 and inward component 78 at the underside of the burner cap so as to prevent movement of the burner cap on the burner body in at least one direction laterally of the burner body when the at least one upper edge of the stability chamber and the undersurface of the burner cap are engaged. It will also be apparent that the irregular configuration of the at least one upper edge of the stability chamber and the complementary irregular configuration of the undersurface of the burner cap can comprise step-like configurations such as shown in the drawings.

Based on the foregoing description it also will be understood that the at least one upper edge of the stability chamber can include a portion such as portion 64 that provides at least a portion of an opening between the stability chamber and the combustible gas chamber when the burner cap is in place on the burner body, whereby the combustible gas can flow from the combustible gas chamber to within the stability chamber.

The construction of the stability chamber 40 as described above provides for a chamber in which a relatively large flame can be established even at a relatively low rate of gas flow to the gas chamber 34. As a consequence, the flame within the interior 50 of the stability chamber will not to be unduly influenced by sudden drafts of air that tend to disturb the flames established at the burner ports 38 and the crossover ports 37 so that the flame within the interior 50 of the stability chamber 40 will serve as a source for reigniting the combustible gas at the burner ports and at the crossover ports 37 whenever gas is flowing through the crossover ports upon the cessation of the disturbance. The functioning of the stability chamber 40 is particularly effective when combustible gas is being delivered to the combustible gas chamber at relatively low rates of flow. In those instances the gas will be burning not only at the burner ports but will also be burning at the crossover ports 37. Under these circumstances, the reestablishment of the combustion of the gas at the crossover ports 37 will facilitate the resumption of combustion at the burner ports 38.

While a particular embodiment of the invention has been shown and described herein, it is to be understood that the invention is not so limited but covers and includes any and all modifications and variations that are encompassed by the following claims.

What is claimed is:

1. A burner assembly at which a combustible gas is combusted comprising:

a burner body comprising an exterior surface, a first interior surface and a second interior surface spaced from the first interior surface, the first interior surface and the second interior surface being joined by a connecting surface to form a combustible gas chamber;

a plurality of burner ports providing openings in the exterior surface of the burner body and the first interior surface of the burner body through which the combustible gas can pass from the combustible gas chamber to the exterior of the burner body and be combusted at the burner ports exterior of the burner body; and a stability chamber in gas-flow communication with the combustible gas in the combustible gas chamber for maintaining the combustion of the combustible gas in the stability chamber whenever the combustion of the combustible gas at the plurality of burner ports is disturbed, whereby the combustion of the combustible gas at the plurality of the burner ports may be resumed upon the cessation of the disturbance, the stability chamber comprising a pair of oppositely disposed side walls, each of which extends from a first end beginning at the second interior surface of the burner body to a second end at the exterior surface of the burner body, at least one of the side walls having an opening that provides gas-flow communication between the combustible gas chamber and the stability chamber, whereby the combustible gas can flow from the combustible gas chamber to within the stability chamber, a front wall located at the second interior surface and joining the first ends of the oppositely disposed side walls of the stability chamber, a rear wall at least partially joining the second ends of the oppositely disposed side walls, and a bottom wall joined to the pair of oppositely disposed side walls, the front wall and the rear wall so as to close off the bottom of the stability chamber.

2. The burner assembly of claim 1 including a burner cap for closing off the top of the burner body, including the top of the stability chamber, so as to substantially preclude the escape of the combustible gas from the combustible gas chamber, the stability chamber and the burner ports at the top of the burner body.

3. The burner assembly of claim 1 wherein each of the pair of oppositely disposed side walls of the stability chamber is arranged substantially transversely to the exterior surface, the first interior surface and the second interior surface of the burner body, each of the oppositely disposed side walls of the stability chamber includes an upper edge comprising a first portion and a second portion aligned substantially end to end from the exterior surface of the burner body toward the second interior surface of the burner body with the second portion of the upper edge being located below the first portion of the upper edge nearer the bottom wall of the stability chamber, the first portion of the upper edge of each side wall of the stability chamber extending between the second end of the side wall at the exterior surface and the second portion of the upper edge of the side wall of the stability chamber, the second portion of the upper edge of each side wall of the stability chamber extending from the first portion of the upper edge of the side wall toward the second interior surface, the upper edge of at least one of the side walls of the stability chamber including a third portion aligned substantially end to end with the second portion of the upper edge of the side wall and extending between the second portion of the upper edge of the side wall and the second interior surface, the third portion of the upper edge of the at least one of the side walls of the stability chamber forming at least a portion of the opening in the at least one of the side walls that is in gas-flow communication with the combustible gas chamber whereby combustible gas can flow from the combustible gas chamber to within the stability chamber.

4. The burner assembly of claim 3 including a burner cap for closing off the top of the burner body, including the top of the stability chamber so as to substantially preclude the escape of the combustible gas from the combustible gas chamber, the stability chamber and the burner ports at the top of the burner body, the burner cap having an undersurface that is configured to complementarily engage the first and second portions of the upper edges of the side walls of the stability chamber so as to substantially preclude the passage of the combustible gas between the stability chamber and the combustion gas chamber at the first and second portions of the upper edges of the side walls of the stability chamber.

5. The burner assembly of claim 3 wherein the first portion of the upper edge of each side wall of the stability chamber is arranged substantially horizontally and the second portion of the upper edge of each side wall of the stability chamber is arranged at an angle to the horizontal such that the second portion of the upper edge of each side wall extends in an upward direction from the first portion of the upper edge of the side wall toward the second interior surface.

6. The burner assembly of claim 5 including a burner cap for closing off the top of the burner body, including the top of the stability chamber so as to substantially preclude the escape of the combustible gas from the combustible gas chamber, the stability gas chamber and the burner ports at the top of the burner body, the burner cap having an undersurface that is configured to complementarily engage the first and second portions of the upper edges of the side walls of the stability chamber so as to substantially preclude the passage of the combustible gas between the stability chamber and the combustion gas chamber at the first and second portions of the upper edges of the side walls of the stability chamber.

7. The burner assembly of claim 6 wherein the first interior surface and the second interior surface of the burner body have a substantially cylindrical configuration and the combustible gas chamber is substantially annular in shape.

8. The burner assembly of claim 1 wherein the bottom wall of the stability chamber is located at a level in the burner body that is lower than the level of the burner ports and the combustible gas chamber, and the top of the rear wall of the stability chamber extends to a location above the bottom wall of the stability chamber and below the upper edges of the pair of opposed side walls of the stability chamber.

9. A burner assembly at which a combustible gas is combusted comprising:

a burner body comprising an exterior surface, a first interior surface and a second interior surface spaced from the first interior surface, the first interior surface and the second interior surface being joined by a connecting surface to form a combustible gas chamber;

a plurality of burner ports providing openings in the exterior surface of the burner body and the first interior surface of the burner body through which the combustible gas can pass from the combustible gas chamber to the exterior of the burner body and be combusted at the burner ports exterior of the burner body; and a stability chamber in gas-flow communication with the combustible gas in the combustible gas chamber for maintaining the combustion of the combustible gas in the stability chamber whenever the combustion of the combustible gas at the plurality of burner ports is disturbed, whereby the combustion of the combustible gas at the plurality of the burner ports may be resumed upon the cessation of the disturbance, the stability chamber extending beginning from the second interior surface of the burner body to the exterior surface of the burner body and having an opening that provides gas-flow communication between the combustible gas chamber and the stability chamber, whereby the combustible gas can flow from the combustible gas chamber to within the stability chamber.

10. The burner assembly of claim 9 including a burner cap for closing off the top of the stability chamber so as to substantially preclude the escape of the combustible gas from the stability chamber.

11. The burner assembly of claim 10 wherein the stability chamber includes at least one upper edge that engages the undersurface of the burner cap, the at least one upper edge of the stability chamber being configured so as to prevent movement of the burner cap on the burner body in at least one direction laterally of the burner body when the at least one upper edge of the stability chamber and the undersurface of the burner cap are engaged.

12. The burner assembly of claim 11 wherein the at least one upper edge of the stability chamber has an irregular configuration that engages a complementary irregular configuration at the undersurface of the burner cap so as to prevent movement of the burner cap on the burner body in at least one direction laterally of the burner body when the at least one upper edge of the stability chamber and the undersurface of the burner cap are engaged.

13. The burner assembly of claim 12 wherein the irregular configuration of the at least one upper edge of the stability chamber and the complementary irregular configuration of the undersurface of the burner cap comprise step-like configurations.

14. The burner assembly of claim 13 wherein the at least one upper edge of the stability chamber includes a portion that provides at least a portion of an opening between the stability chamber and the combustible gas chamber when the burner cap is in place on the burner body, whereby the combustible gas can flow from the combustible gas chamber to within the stability chamber.

15. A burner assembly at which a combustible gas is combusted comprising:

a burner body including a combustible gas chamber for holding the combustible gas and a plurality of burner ports, the combustible gas chamber being formed between a first interior surface and a second interior surface spaced from the first interior surface, the first and second interior surfaces being joined by a connecting interior surface;

a stability chamber in gas-flow communication with the combustible gas chamber, whereby the combustible gas can flow from the combustible gas chamber to within the stability chamber for maintaining the combustion of the combustible gas in the stability chamber whenever the combustion of the combustible gas at the plurality of burner ports is disturbed so that the combustion of the combustible gas at the plurality of the burner ports may be resumed upon the cessation of the disturbance, the stability chamber including at least one upper edge that is adapted to engage the undersurface of a burner cap for closing off the top of the burner body, the at least one upper edge of the stability chamber being configured so as to prevent movement of the burner cap on the burner body in at least one direction laterally of the burner body when the at least one upper edge of the stability chamber and the undersurface of the burner cap are engaged wherein the stability chamber includes two side walls each of which includes a respective one of two upper edges of the stability chamber, each of the two upper edges including a first portion and a second portion aligned substantially end to end with the second portion of the upper edge being located below the first portion of the upper edge nearer the bottom of the stability chamber, at least one of the two upper edges of the stability chamber including a third portion aligned substantially end to end with the second portion of the at least one of the two upper edges and the second interior surface, and extending between the second portion and the second interior surface, the third portion of the at least one of the two upper edges of the stability chamber forming at least a portion of an opening in one of the side walls of the stability chamber that provides gas-flow communication between the combustible gas chamber and the stability chamber, whereby combustible gas can flow from the combustible gas chamber to within the stability chamber.

16. The burner assembly of claim 15 wherein the at least one upper edge of the stability chamber includes a portion that provides at least a portion of an opening between the stability chamber and the combustible gas chamber when the burner cap is in place on the burner body, whereby the combustible gas can flow from the combustible gas chamber to within the stability chamber.

17. The burner assembly of claim 15 wherein the at least one upper edge of the stability chamber has an irregular configuration that is adapted to engage a complementary irregular configuration at the undersurface of the burner cap so as to prevent movement of the burner cap on the burner body in at least one direction laterally of the burner body when the at least one upper edge of the stability chamber and the undersurface of the burner cap are engaged.

18. The burner assembly of claim 17 wherein the irregular configuration of the at least one upper edge of the stability chamber and the complementary irregular configuration of the undersurface of the burner cap comprise step-like configurations.

19. The burner assembly of claim 18 wherein the at least one upper edge of the stability chamber includes a portion that provides at least a portion of an opening between the stability chamber and the combustible gas chamber when the burner cap is in place on the burner body, whereby the combustible gas can flow from the combustible gas chamber to within the stability chamber.

20. The burner assembly of claim 15 wherein the third portion is bordered by the second portion and by the second interior surface.

* * * * *